US012369712B2

(12) United States Patent
Kibby et al.

(10) Patent No.: US 12,369,712 B2
(45) Date of Patent: Jul. 29, 2025

(54) GLIDE ASSEMBLY SYSTEM

(71) Applicant: Jasper Seating Company Inc., Jasper, IN (US)

(72) Inventors: Jeremy S. Kibby, Jasper, IN (US); Michael R. Shields, Greensboro, NC (US)

(73) Assignee: Jasper Seating Company Inc., Jasper, IN (US)

( * ) Notice: Subject to any disclaimer, the term of this patent is extended or adjusted under 35 U.S.C. 154(b) by 5 days.

(21) Appl. No.: 18/136,667

(22) Filed: Apr. 19, 2023

(65) Prior Publication Data

US 2024/0349893 A1 Oct. 24, 2024

(51) Int. Cl.
*A47B 91/06* (2006.01)
*A47C 1/124* (2006.01)

(52) U.S. Cl.
CPC ..... *A47B 91/06* (2013.01); *A47C 1/124* (2013.01)

(58) Field of Classification Search
CPC ..... A47C 1/124; A47C 13/005; A47B 91/06
USPC ..... 248/188.9; 24/303; 297/248, 233; 16/42 R
See application file for complete search history.

(56) References Cited

U.S. PATENT DOCUMENTS 2,546,492 A * 3/1951 Booth ..... A47B 91/04 248/188.8
2,628,384 A * 2/1953 Shomber ..... A47B 91/06 16/42 T
2,632,198 A * 3/1953 Becker ..... A47B 91/04 16/42 T
2,709,830 A * 6/1955 Becker ..... A47B 91/04 16/42 T
2,766,475 A * 10/1956 Becker ..... A47B 91/12 16/42 T
3,328,075 A 6/1967 Albinson
3,831,936 A * 8/1974 Watson ..... A63B 5/11 482/27
4,386,804 A 6/1983 Ware et al.
4,657,302 A 4/1987 Snyder
5,129,703 A 7/1992 Ballendat et al.
5,282,669 A 2/1994 Barile
5,542,159 A * 8/1996 Schultz ..... A47C 1/124 24/341
5,863,096 A 1/1999 Bartlmae
6,338,528 B1 1/2002 Lohness et al.
6,623,082 B1 * 9/2003 Huang ..... A47C 7/002 248/188.9
7,017,990 B2 3/2006 Mendenhall et al.
7,708,349 B2 5/2010 Chen
(Continued)

*Primary Examiner* — Ingrid M Weinhold
(74) *Attorney, Agent, or Firm* — Dentons Bingham Greenebaum LLP; James C. Eaves, Jr.; Brian W. Chellgren

(57) ABSTRACT

The present invention relates to a glide assembly to connect adjacent furniture legs on items such as, for example, chairs or tables. For example, chairs can have a glide assembly attached at the bottom of each of its front legs or to all of its legs, or a table can have a glide attached to some or all of its legs. Each glide may have a magnet that, when mated with adjacent glide's magnet, connects the chair legs and/or table legs together, without requiring tools or mechanical fasteners to connect or disconnect. The magnets used to connect the chairs and tables together allows one to easily attach or detach chairs and/or tables. Use of male/female glide assemblies increases the resistance to accidental disconnection.

13 Claims, 9 Drawing Sheets

(56) References Cited

U.S. PATENT DOCUMENTS

| | | | | |
|---|---|---|---|---|
| 9,282,823 | B2 * | 3/2016 | Kumazawa | A47C 1/124 |
| 9,725,243 | B2 * | 8/2017 | Poynter | B65G 7/02 |
| 10,578,140 | B2 * | 3/2020 | Porter | F16B 12/12 |
| 10,881,212 | B2 | 1/2021 | Liu | |
| 11,457,739 | B2 * | 10/2022 | Putzke | A47B 91/00 |
| 2010/0176634 | A1 * | 7/2010 | Wahl | A47C 13/005 297/248 |
| 2012/0013156 | A1 * | 1/2012 | Tsai | A47C 1/124 297/248 |
| 2013/0255044 | A1 | 10/2013 | Chen | |
| 2021/0196045 | A1 * | 7/2021 | Putzke | A47B 91/00 |
| 2025/0067295 | A1 * | 2/2025 | Lee | A47C 13/005 |

* cited by examiner

GLIDE ASSEMBLY SYSTEM

FIELD

The present invention relates to a glide assembly system to connect adjacent furniture legs on items such as, for example, chairs or tables. For example, chairs can have a glide assembly attached at the bottom of each of its front legs or to all of its legs, or a table can have a glide attached to some or all of its legs. Each glide may have a magnet that, when mated with adjacent glide's magnet, connects the chair legs and/or table legs together, without requiring tools or mechanical fasteners to connect or disconnect. The magnets used to connect the chairs and tables together allows one to easily attach or detach chairs and/or tables. Use of male/female glide assemblies increases the resistance to accidental disconnection.

BACKGROUND

In many environments, it is desirable to have a row or rows of chairs where the chairs appear more presentable if the rows are aligned. The situation can be the same for tables, or other furniture items. For example, one may want several tables aligned end to end, or side by side. Also, one may want multiple tables aligned both end to end and side by side, for example 6 tables aligned 3 tables long and 2 tables wide to create a larger meeting or display table.

While chairs or tables or other furniture items can be set-up so that they are aligned as desired, if they are not connected in some way, they are easy to become misaligned. The ability to easily connect and disconnect the furniture items is also preferable, as disconnecting allows for easier storage of the furniture items.

Over the years, various mechanical connectors have been used to connect chairs together, either permanently or temporarily. Examples include bent arms and cavities, where the arms are connected into the cavities to connect chairs; a keyway on one side of a chair and an engaging key on a side of an adjacent chair; legged chairs with upstanding posts having an unlegged chair between a pair of legged chairs where the unlegged chair has sockets that fit onto the upper end of the upstanding posts of the adjacent legged chairs; and chairs with a pair of spaced apart N-S magnets along a chair seat which can mate with a pair of spaced apart S-N magnets along the seat of another chair.

SUMMARY

A glide assembly system to connect adjacent furniture legs involves male and female glide assemblies which are insertable into the legs of furniture. A male glide assembly inserted into the leg of a piece of furniture which abuts a female glide assembly inserted into the leg of an adjacent piece of furniture is used to connect the legs of the furniture together until the furniture is pulled apart to separate.

The glide assemblies preferably have a body with a curved bottom surface which make it easier to slide the furniture along a floor surface. A male glide assembly has a magnetic assembly extending from a receptacle and a female glide assembly has a magnetic assembly received internal to a receptacle. The metal cup of the magnetic assembly in the male glide assembly is inserted into the receptacle in the female glide assembly to engage the metal cup of the magnetic assembly in the female glide assembly. In some embodiments, two magnets of opposed polarity are used in the magnetic assemblies of the male and female glide assemblies. It is noted that non-polarized magnets provide connectivity, but it is preferable to use polarized N-S magnets thereby enhancing the strength of the connection. In other embodiments, a magnet may be used in one of the glide assemblies and a member magnetically attracted to the magnet may be used in the other glide assembly. Male/female glide assembly conjunction with magnets increases the resistance to accidental disconnection by providing added resistance when vertical and horizontal forces are applied to the conjunction.

The male and female glide assemblies each have a body which may be of unitary or non-unitary construction. In some embodiments, the body is injection molded.

More specifically, the present invention is for a glide assembly system to connect adjacent furniture legs, including a) a male glide assembly having a body, the body having a curved bottom portion, the body having an upward extending leg insertion portion and a receptacle extending transverse to the leg insertion portion, the receptacle having a receptacle depth from its interior outward; a magnet assembly having a metal cup having an exterior cup depth and an interior cup depth, the metal cup having a bottom and a wall portion, the wall portion having a non-metallic spacer on its interior wall portion, the metal cup receiving a magnet therein, the magnet attached to the bottom of the metal cup and abutting the non-metallic spacer, the magnet having a magnetic depth, the magnetic depth being less that the interior cup depth of the metal cup, the magnet assembly received into the receptacle of the male glide assembly, the receptacle depth being less than the exterior cup depth of the metal cup; b) a female glide assembly having a body, the body having a curved bottom portion, the body having an upward extending leg insertion portion and a receptacle extending transverse to the leg insertion portion, the receptacle having a receptacle depth from its interior outward; a magnet assembly having a metal cup having an exterior cup depth and an interior cup depth, the metal cup having a bottom and a wall portion, the wall portion having a non-metallic spacer on its interior wall portion, the metal cup receiving a magnet therein, the magnet attached to the bottom of the metal cup and abutting the non-metallic spacer, the magnet having a magnetic depth, the magnetic depth being less that the interior cup depth of the metal cup, the magnet assembly received into the receptacle of the female glide assembly, the receptacle depth being more than the exterior cup depth of the metal cup; and c) where the metal cup of the male glide assembly can engage the metal cup of the female glide assembly and prevent the male and female glide assembly magnets from touching, and also prevent the male and female glide assembly receptacles from touching.

In this situation, male and female glide assembly magnets may have an opposite polarity to each other, although non-polarized magnets may be used. The body of each glide member may be unitary or non-unitary. In the unitary body, magnet assemblies of the male and female glide assemblies each have a central countersunk opening therethrough, the receptacles of the male and female glide assemblies each have a central pilot hole extending into the body, a fastener received through each central countersunk opening of the magnet assemblies and received into the pilot hole of the bodies. A preferred fastener is a screw which is threaded into the pilot hole. Other possible fasteners include bolts and rivets.

In the non-unitary body, the receptacles of the male and female glide assemblies each have a central opening extending through the body to the side opposite each receptacle, each central opening having a key slot extending inward from the body side opposite each receptacle, where an adapter is inserted into the central opening from the body side opposite each receptacle of the male and female glide assemblies, each adapter having a head and a shaft, the shaft having a key thereon, the key extending outward from the shaft adjacent the adapter head, the shaft having a central pilot hole extending inward from the shaft end opposite the head toward the receptacle, where the key slot and key engage each other. Even further, the magnet assemblies of the male and female glide assemblies each have a central countersunk opening therethrough, with a fastener received through each central countersunk opening of the magnet assemblies and received into the central pilot hole of the shaft.

To utilize the glide assembly system to connect chairs together, a male glide assembly is received into the right front leg of a first chair and a female glide assembly is received into the left front leg of the first chair, a male glide assembly is received into the right front leg of a second chair and a female glide assembly is received into the left front leg of the second chair, the first and second chairs being connectable by having the metal cup in one of the male glide assemblies engage the metal cup in one of the female glide assemblies.

As an alternative to using a magnet assembly in both of the male and female glide assemblies, one of the magnet assemblies can be replaced with a member which is magnetically attracted to the magnet assembly of the other glide assembly, the member having a member depth, the member received into the receptacle of the glide assembly. For a female glide assembly, the receptacle depth will be more than the member depth. If used with a male glide assembly, the receptacle depth will be less than the member depth. The metal cup of the glide assembly with the magnet assembly can engage the member of the other glide assembly and prevent the magnet in the glide assembly with the magnet assembly from touching the member in the other glide assembly, and also prevent the two glide assembly receptacles from touching.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

DETAILED DESCRIPTION OF THE ILLUSTRATED EMBODIMENTS

Figure 1:
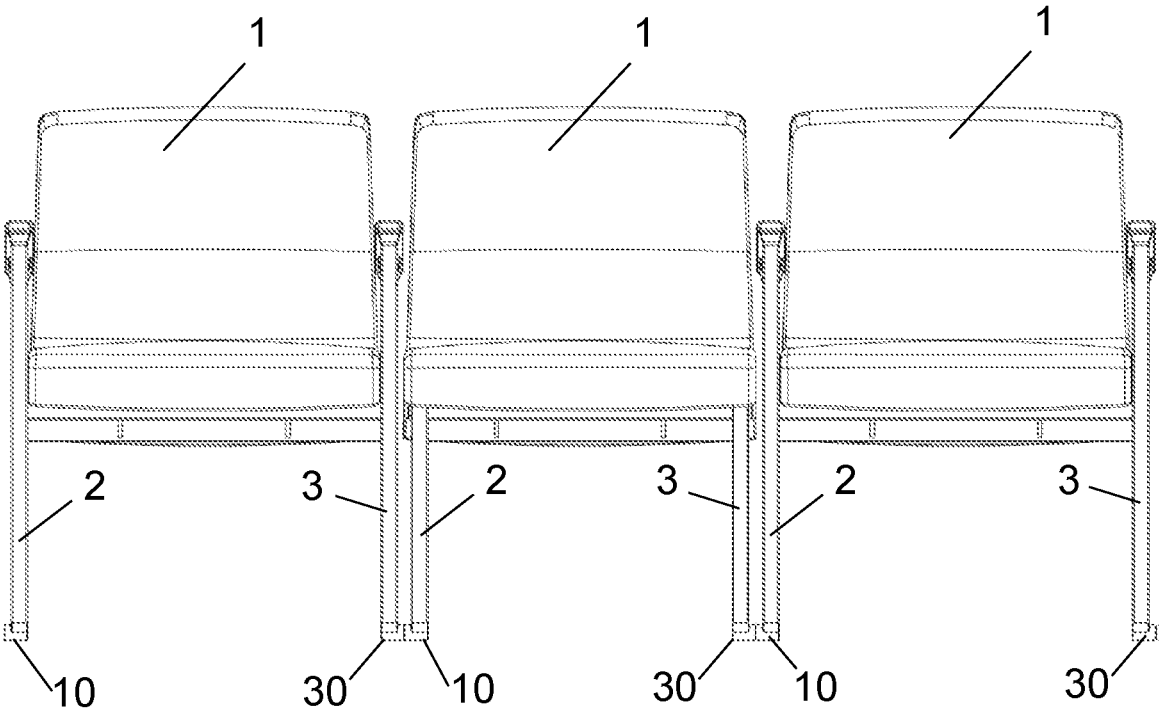
FIG. 1 is a front view of three chairs arranged side by side with each of their legs having a glide assembly inserted into each front chair leg, the center chair being connected to the chairs on its left and right by connected male and female glide assemblies.

For the purposes of promoting an understanding of the principles of the invention disclosed herein, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein; such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Embodiments of the present glide assembly system include a male and a female glide assembly which permits easy connecting and disconnecting the legs of adjacent furniture, for example, to maintain multiple chairs in a row. The body of the glide assemblies can be a single or multi-part assembly.

The following numbers are used in the drawings: 1—chair; 2—chair front right leg; 3—chair front left leg; 10—male glide assembly; 12—body; 13—curved bottom; 14—leg insertion portion; 16—receptacle; 17—metal cup; 18—north polarized magnet; 19—spacer; 20—fastener; 22—pilot hole; 23—countersunk opening in magnet; 24—gap between magnets when adjacent glide assemblies are closed; 26—gap between receptacles when adjacent glide assemblies are closed; 30—female glide assembly; 32—body; 36—receptacle; 38—south polarized magnet; 70—member; 100—alternate embodiment male glide assembly; 102—body; 103—curved bottom; 115—body opening to receive adapter; 117—key slot; 120—adapter; 121—shaft; 122—pilot hole; 123—head; 124—key; 130—alternate embodiment female glide assembly; 132—body; 133—curved bottom; and glide assembly 300 with metallic member.

FIG. 1 shows three chairs 1 in a side by side relationship. Each chair has a male glide assembly 10 inserted into the bottom of its right front leg 2 and a female glide assembly 30 inserted into the bottom of its left front leg 3. As is explained in more detail later, the chair 1 shown on the left and the chair 1 in the center are connected by female 30 and male 10 glide assemblies on their respective left and right front legs 3 and 2. Further the chair 1 shown in the center and the chair 1 shown on the right are connected by female 30 and male 10 glide assemblies on their respective left and right front legs 3 and 2. These connections are not permanent and the chairs can be easily disconnected by pulling them apart side to side. Any number of chairs can be connected in a row as are the three chairs 1 shown by adding additional chairs, each having a male glide assembly 10 inserted into the bottom of its right front leg 2 and a female glide assembly 30 inserted into the bottom of its left front leg 3. In other embodiments (not shown), the male glide assembly 10 may be inserted into the bottom of the left front leg 3 of each chair 1 and the female glide assembly 30 may be inserted into the bottom of the right front leg 2 of each chair 1.

Figure 2A:
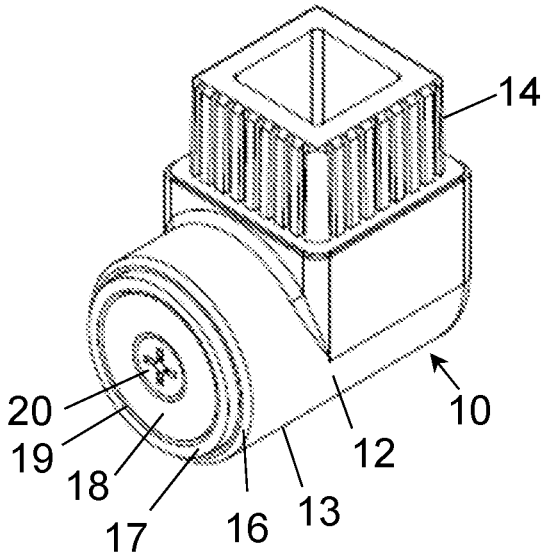
FIG. 2A is a perspective view of a male glide assembly having a unitary body.
Figure 2B:
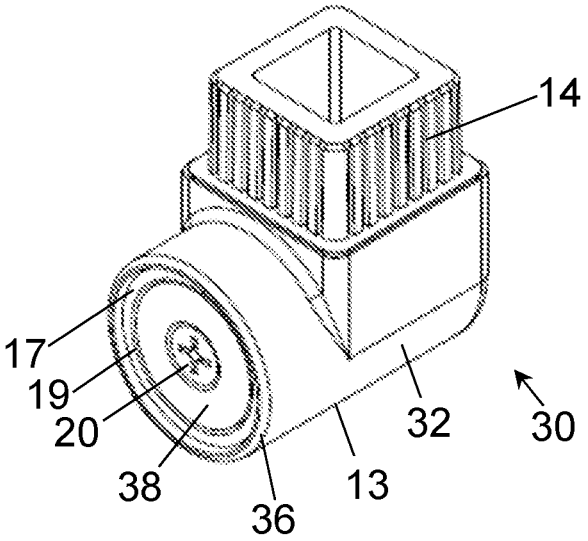
FIG. 2B is a perspective view of a female glide assembly having a unitary body.
Figure 3A:
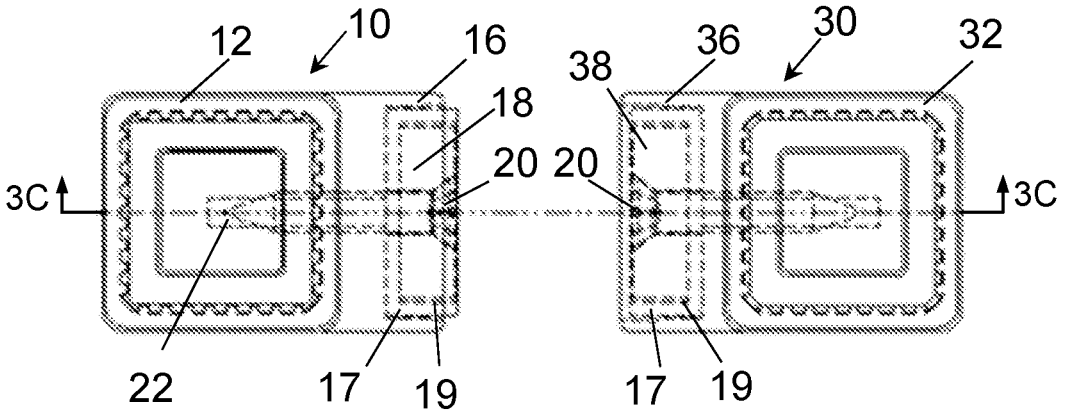
FIG. 3A demonstrates from the top the relationship of the components making up the male glide assembly of FIG. 2A (on the left) and the female glide assembly of FIG. 2B (on the right), the glide assemblies being separated.
Figure 3B:
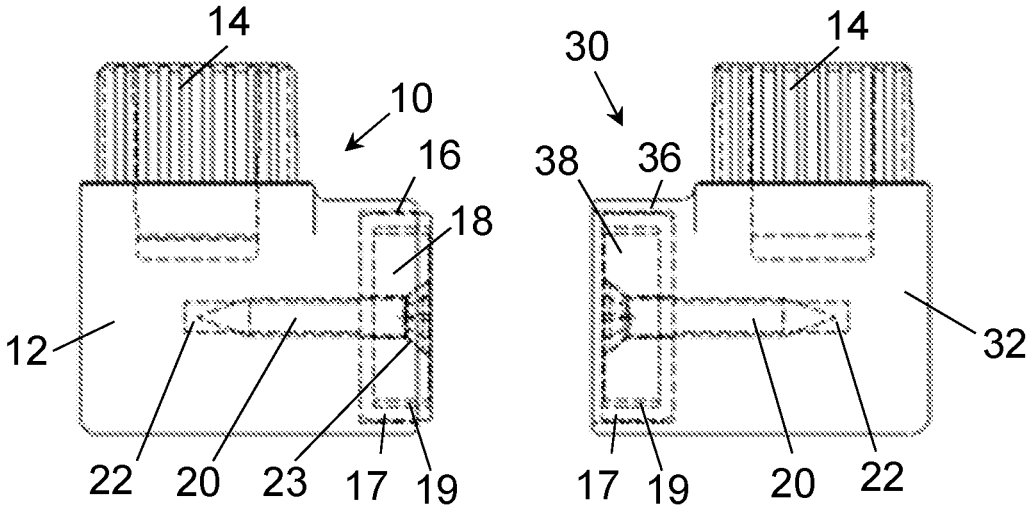
FIG. 3B demonstrates from the side the relationship of the components making up the male glide assembly of FIG. 2A (on the left) and the female glide assembly of FIG. 2B (on the right), the glide assemblies being separated.
Figure 3C:
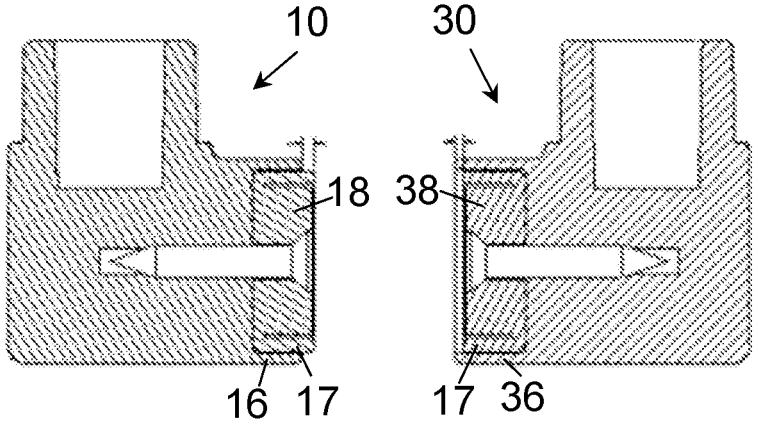
FIG. 3C is a section view along the lines 3C-3C of FIG. 3A of the components making up the male glide assembly of FIG. 2A (on the left) and the female glide assembly of FIG. 2B (on the right), the glide assemblies being separated.
Figure 4A:
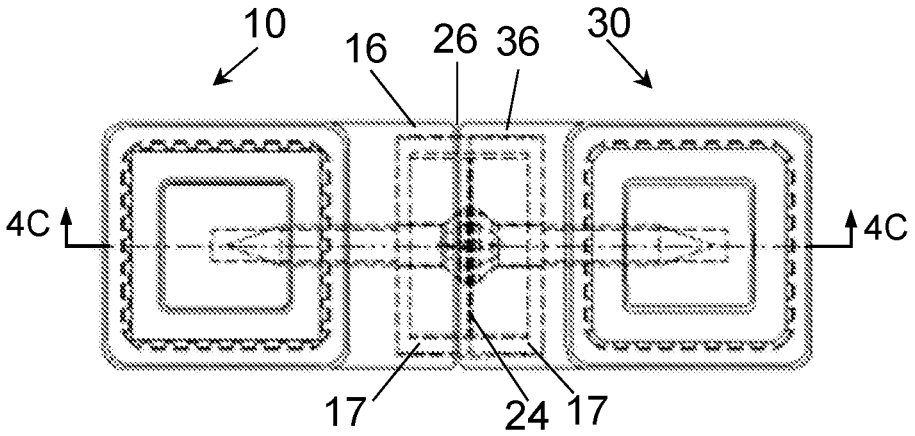
FIG. 4A demonstrates from the top the relationship of the components making up the male glide assembly of FIG. 2A (on the left) and the female glide assembly of FIG. 2B (on the right), the glide assemblies being connected.
Figure 4B:
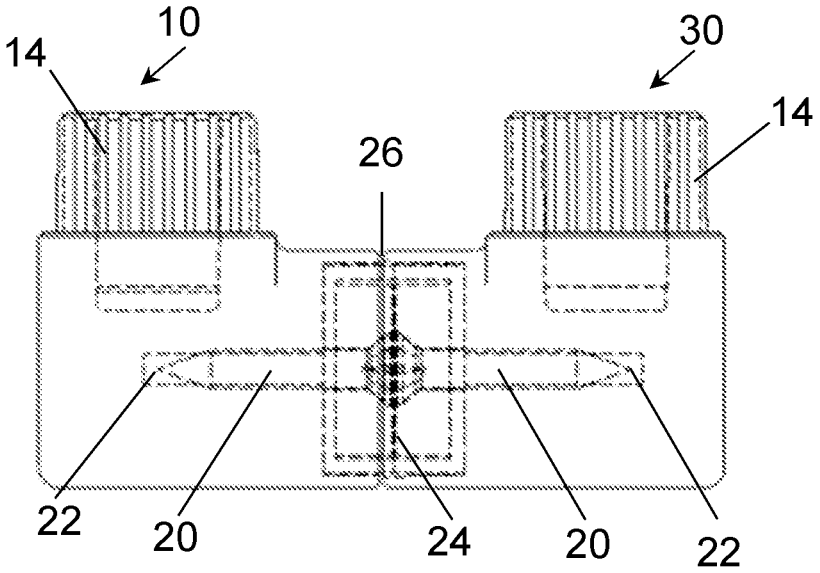
FIG. 4B demonstrates from the side the relationship of the components making up the male glide assembly of FIG. 2A (on the left) and the female glide assembly of FIG. 2B (on the right), the glide assemblies being connected.
Figure 4C:
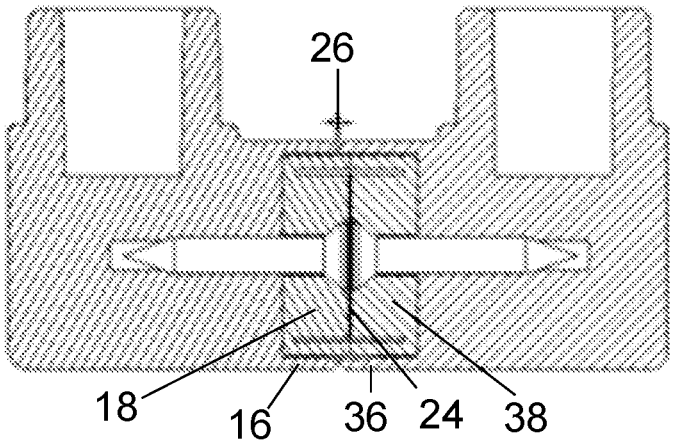
FIG. 4C is a section view along the lines 4C-4C of FIG. 4A of the components making up the male glide assembly of FIG. 2A (on the left) and the female glide assembly of FIG. 2B (on the right), the glide assemblies being connected.

FIG. 2A shows a male glide assembly 10 having a unitary body 12 and FIG. 2B shows a female glide assembly 30 having a unitary body 32. FIGS. 3A, 3B, and 3C show glide assemblies 10 and 30 in a spaced apart relationship, while FIGS. 4A, 4B, and 4C show glide assemblies 10 and 30 in a connected relationship.

Glide assemblies 10 and 30 are preferably injection molded using a glass filled nylon material, although other materials and manufacturing techniques may also be used. The bodies 12 and 32 of glide assemblies 10 and 30 each have a curved bottom 13 and a leg insertion portion 14 extending upward. Male glide assembly 10 has a receptacle 16 and female glide assembly 30 has a receptacle 36 each extending transverse to the upward leg insertion portion 14. Each receptacle 16/36 has a receptacle depth from its interior outward. The receptacle depth of the male glide assembly is less than the receptacle depth of the female glide assembly.

A magnet assembly preferably used with each glide assembly has a metal cup 17, preferably of a steel material, which has an exterior cup depth and an interior cup depth. Each metal cup 17 has a bottom and a wall portion, the wall portion having a non-metallic spacer 19 on its interior portion. Spacer 19 is preferably of a nylon or plastic material. Metal cup 17 used with the male glide assembly 10 receptacle 16 receives a magnet 18 therein and metal cup 17 used with the female glide assembly 30 receptacle 36 receives a magnet 38 therein. Magnets 18 and 38 are preferably made of neodymium, but can be made of other magnetic material. Magnets 18 and 38 are attached to the bottom of their respective metal cups 17 and abut the non-metallic spacer 19 inside each cup 17. Magnets 18 and 38 have a magnet depth which is less than the interior cup depth of the respective metal cup 17.

Magnets 18 and 38 should have opposing polarity to each other. While polarity could be flipped, as shown, magnet 18 has north polarity exposed and magnet 38 has south polarity exposed. With magnet 18 inserted into cup 17 and attaching to the cup bottom and not touching the cup sides due to spacer 19, the exposed outer edge of the metal cup 17 will also be of north polarity. Likewise, for magnet 38, the exposed outer edge of the metal cup 17 will be of south polarity.

The magnet assemblies with magnets 18 and 38 are received into the receptacle 16 of the male glide assembly 10 and the receptacle 36 of the female glide assembly 30. For the male glide assembly 10, the receptacle 16 depth is less than the exterior cup depth of the associated metal cup 17. In contrast, for the female glide assembly 30, the receptacle 36 depth is more than the exterior cup depth of the associated metal cup 17. With these dimensional relationships, when the male glide assembly 10's exposed north polarized outer edge of metal cup 17 connects to the female glide assembly 30's exposed south polarized outer edge of metal cup 17, magnets 18 and 38 can not touch. Also, the outer edges of the male and female glide assemblies 10 and 30 can not touch.

In this embodiment of FIGS. 2A to 4C, the magnet assemblies of the male and female glide assemblies 10 and 30 each have a central countersunk opening 23 therethrough, the receptacles 16/36 of the male and female glide assemblies 10/30 each have a central pilot hole 22 extending into the body 12/32, and a fastener 20, such as a screw, bolt, rivet, or other fastener, is received through each central countersunk opening 23 of the magnet assemblies and received into the pilot hole 22. For example, a #8×¾ inch flat head screw is a preferred fastener and is received through each central countersunk opening 23 of the magnet assemblies and threaded into the pilot hole 22 of the bodies 12.

With particular reference to FIG. 3C, male glide assembly 10 is shown with metal cup 17 extending 0.057 inch beyond the end of receptacle 16. Female glide assembly 30 is shown with metal cup 17 recessed into receptacle 36 by 0.44 inches. The magnet assemblies of both male 10 and female 30 glide assemblies have their respective magnets 18 and 38 recessed into each metal cup 17 by 1/128 inch. Likewise, when looking at FIG. 4C, male 10 and female 30 glide assemblies are shown with the outer ends of their metal cups 17 touching, thereby connecting the glide assemblies 10/30 together. As shown, in this connected relationship, the space 24 between magnets 18 and 38 is 1/64 inch and the space 26 between the outer ends of receptacles 16 and 36 is 0.013 inch. Magnets, such as magnets 18 and 38 can be fragile and subject to breakage. The relationship shown protects the magnets from such breakage, but still places them sufficiently close together that they function, along with the touching metal cups, to maintain the glide assemblies 10/30 in a connected relationship until a sufficient external force is applied to pull them apart. Also, the edges of body 12/32 where receptacles 16/36 are located are relatively thin. By not allowing these edges to touch when the glide assemblies 10/30 are in a connected relationship, these relatively thin outer edges of receptacles 16/36 are also protected.

Figure 5A:
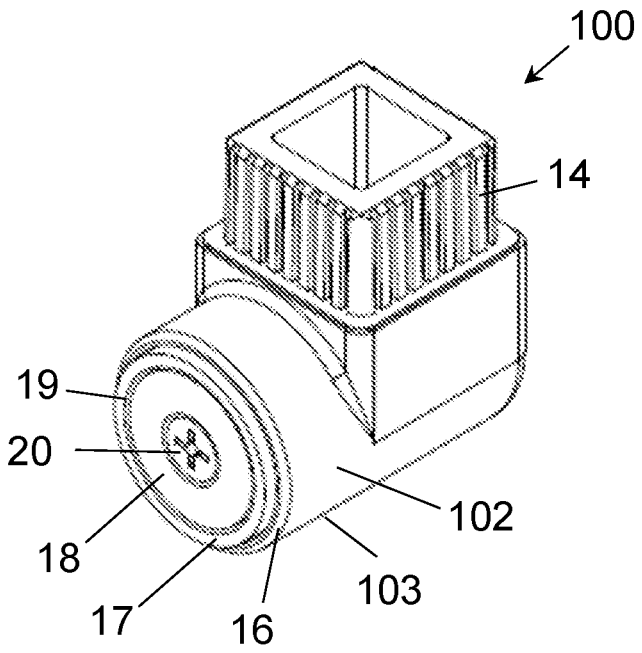
FIG. 5A is a perspective view of an alternative male glide assembly having an adapter received into an opening in the body.
Figure 5B:
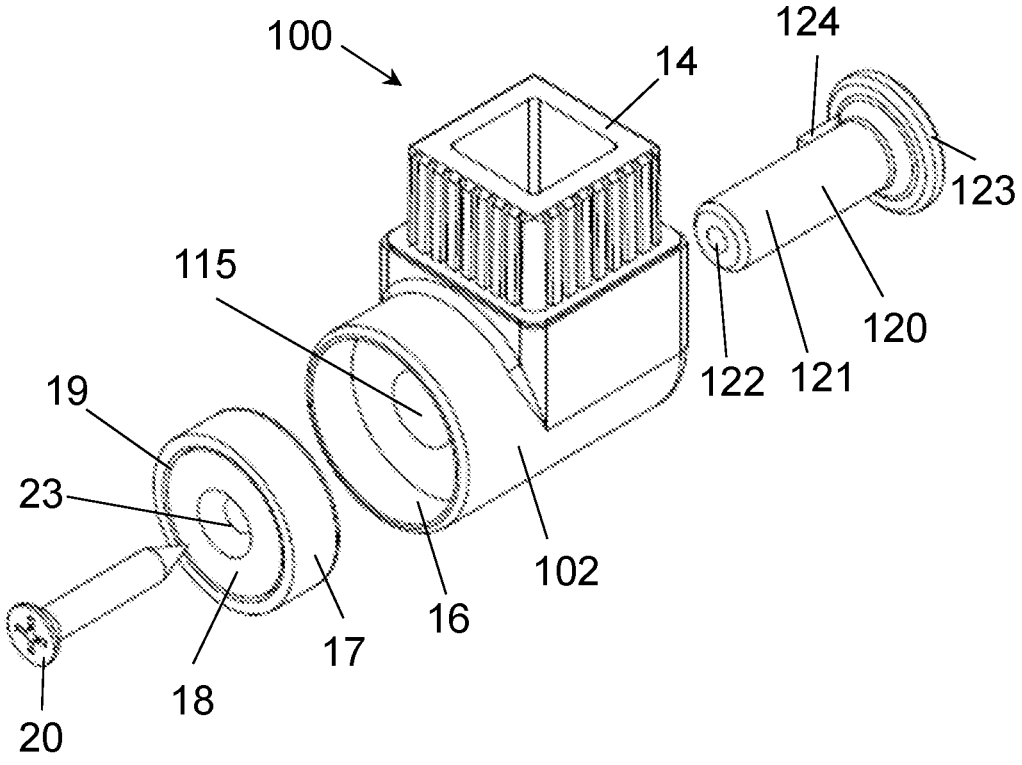
FIG. 5B is an exploded perspective view of the alternative male glide assembly of FIG. 5A.
Figure 5C:
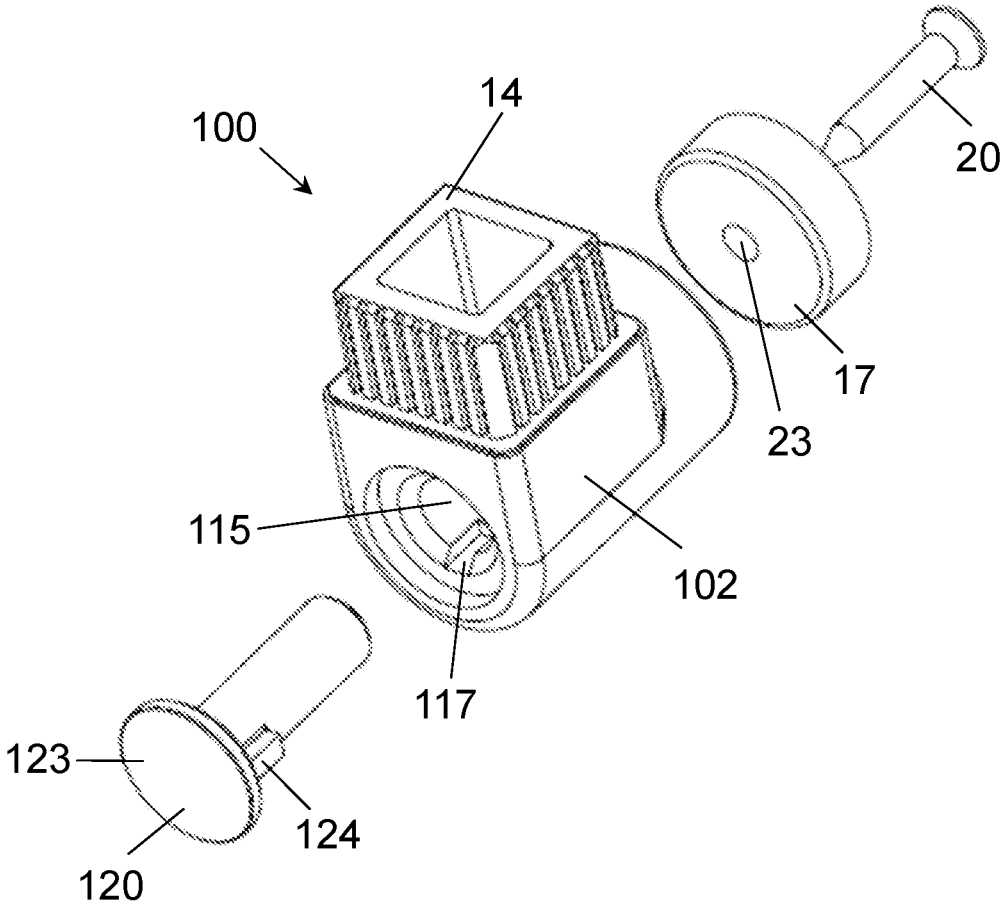
FIG. 5C is an exploded perspective view of the alternative male glide assembly of FIG. 5A, with the glide assembly rotated about 180° from the orientation seen in FIG. 5B.
Figure 6A:
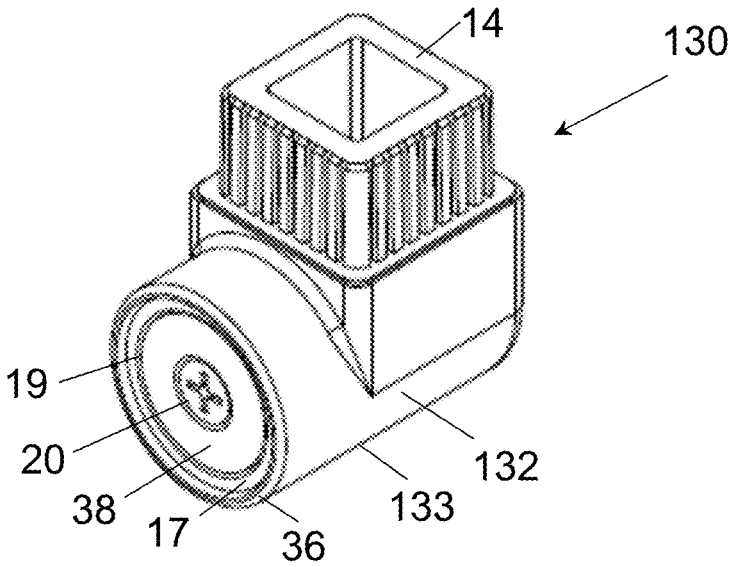
FIG. 6A is a perspective view of an alternative female glide assembly having an adapter received into an opening in the body.
Figure 6B:
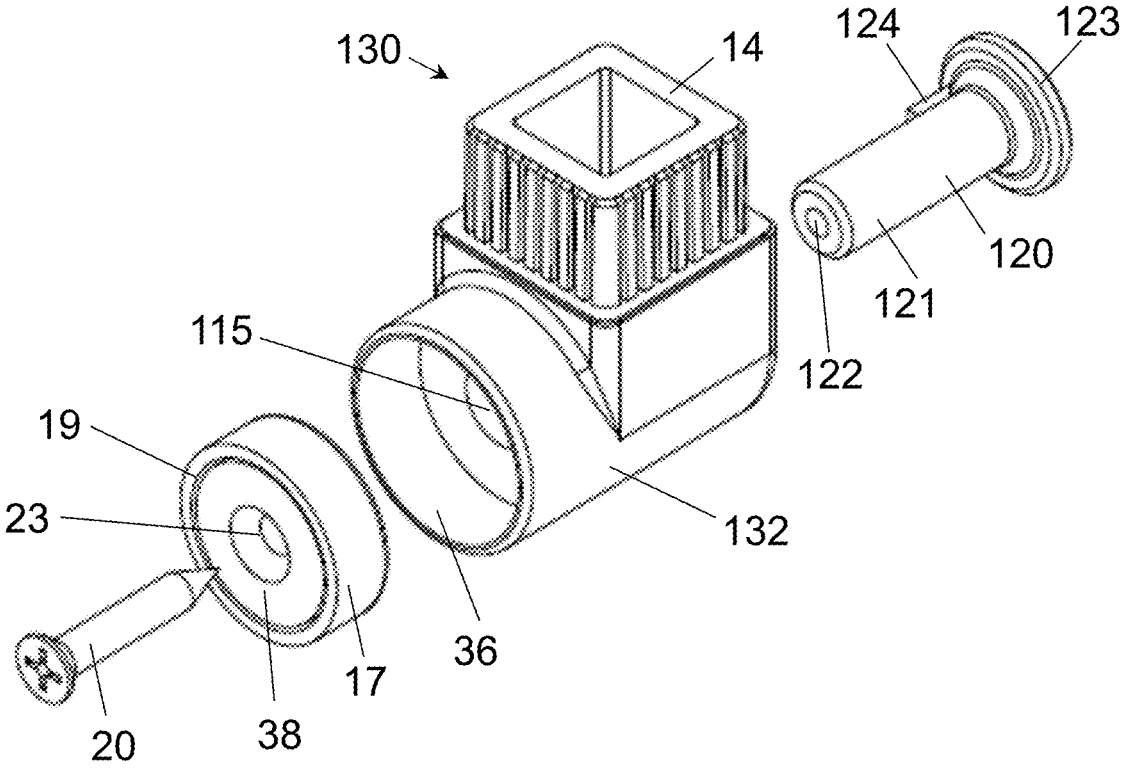
FIG. 6B is an exploded perspective view of the alternative female glide assembly of FIG. 6A.
Figure 7A:
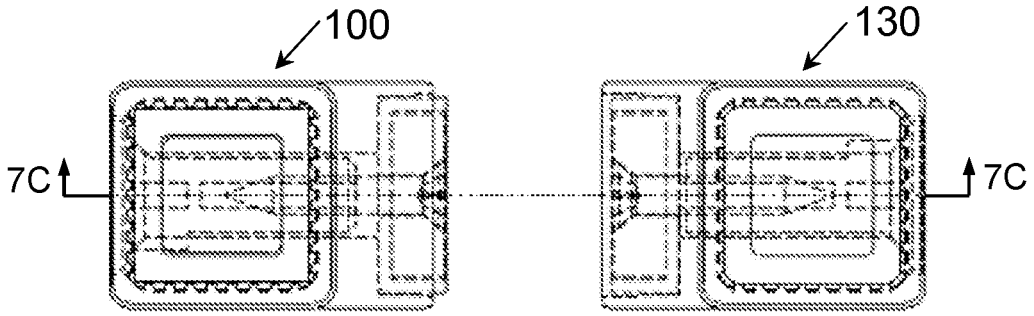
FIG. 7A demonstrates from the top the relationship of the components making up the alternative male glide assembly of FIG. 5A (on the left) and the alternative female glide assembly of FIG. 6A (on the right), the glide assemblies being separated.
Figure 7B:
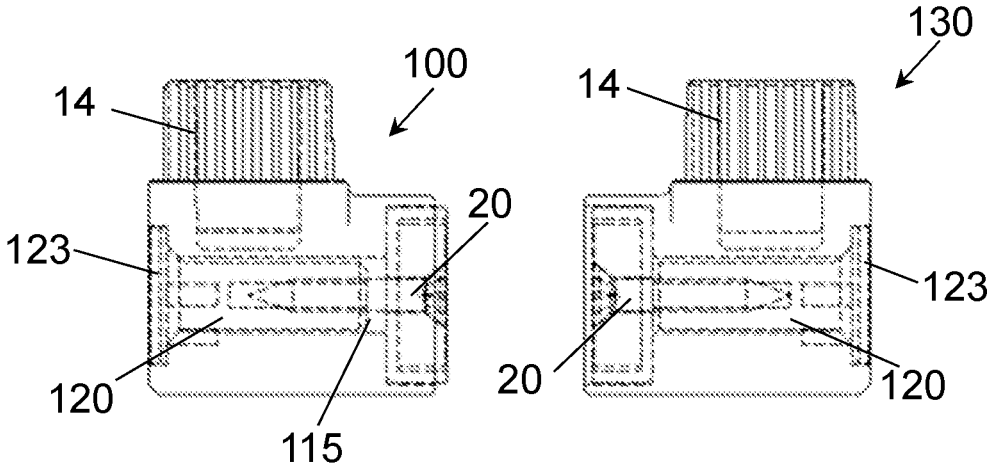
FIG. 7B demonstrates from the side the relationship of the components making up the male glide assembly of FIG. 5A (on the left) and the female glide assembly of FIG. 6A (on the right), the glide assemblies being separated.
Figure 7C:
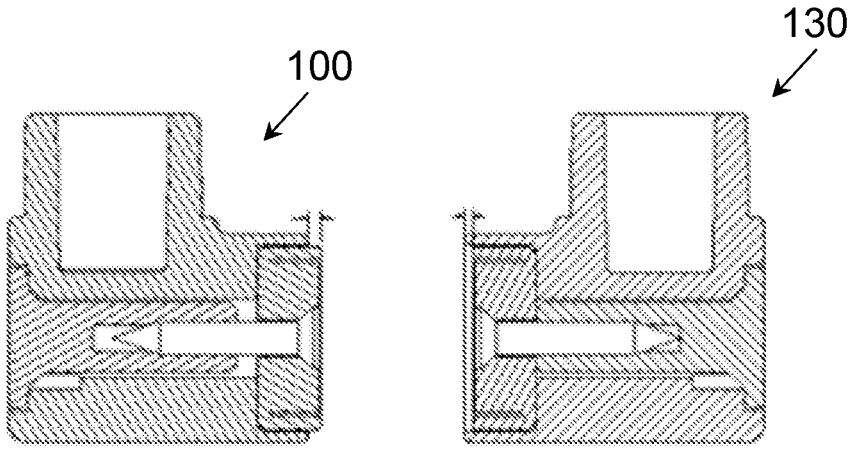
FIG. 7C is a section view along the lines 7C-7C of FIG. 7A of the components making up the male glide assembly of FIG. 5A (on the left) and the female glide assembly of FIG. 6A (on the right), the glide assemblies being separated.
Figure 8A:
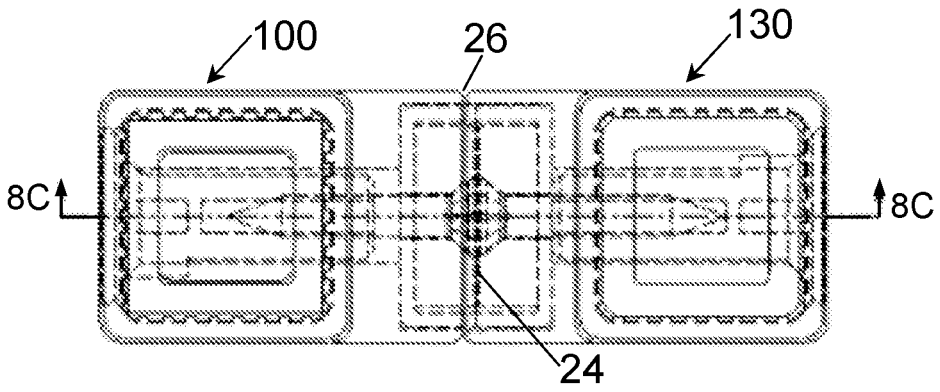
FIG. 8A demonstrates from the top the relationship of the components making up the alternative male glide assembly of FIG. 5A (on the left) and the alternative female glide assembly of FIG. 6A (on the right), the glide assemblies being connected.
Figure 8B:
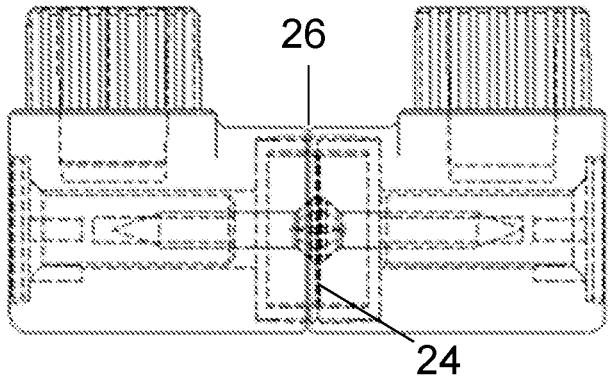
FIG. 8B demonstrates from the side the relationship of the components making up the male glide assembly of FIG. 5A (on the left) and the female glide assembly of FIG. 6A (on the right), the glide assemblies being connected.
Figure 8C:
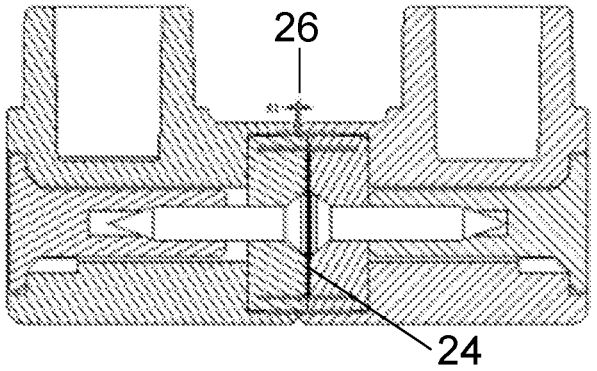
FIG. 8C is a section view along the lines 8C-8C of FIG. 8A of the components making up the male glide assembly of FIG. 5A (on the left) and the female glide assembly of FIG. 6A (on the right), the glide assemblies being connected.

FIG. 5A shows a perspective view of an alternative male glide assembly 100 having an adapter 120 received into an opening 115 in the body 102 and FIG. 6A is a perspective view of an alternative female glide assembly 130 having an adapter 120 received into an opening 115 in the body 132. FIG. 5B shows an exploded perspective view of the male glide assembly 100 of FIG. 5A. FIG. 5C shows the exploded perspective view of FIG. 5B rotated 180 degrees. FIG. 6B Figure shows an exploded perspective view of the female glide assembly 130 of FIG. 6A. FIGS. 7A, 7B, and 7C show glide assemblies 100 and 130 in a spaced apart relationship, while FIGS. 8A, 8B, and 8C show glide assemblies 100 and 130 in a connected relationship.

The body 102 of male glide assembly 100 in FIGS. 5A/5B/5C has a curved bottom 103, an upward extending leg insertion member 14, and a receptacle 16. Insertion member 14 and receptacle 16 are as in male glide assembly 10. With assembly 100, the receptacle 16 has a central opening 115 extending through body 102 to the side opposite the receptacle 16, the central opening 115 having a key slot 117 extending inward from the body 102 side opposite the receptacle 16, where an adapter 120 is inserted into the central opening 115 from the body 102 side opposite each receptacle 16 of the male glide assembly 100, the adapter 120 having a head 123 and a shaft 121, the shaft 121 having a key 124 thereon, the key 124 extending outward from the shaft 121 adjacent the adapter head 123, the shaft 120 having a central pilot hole 122 extending inward from the shaft 121 end opposite the head 123 toward the receptacle 16, where the key slot 117 and key 124 engage each other.

With male glide assembly 100, the magnet assemblies have a central countersunk opening 23 therethrough and a screw 20 is received through the central countersunk opening 23 of the magnet assemblies and threaded into the central pilot hole 122 of the shaft 120. As screw 20 is threaded into central pilot hole 122, the engaged key slot 117 and key 124 prevent the adapter 120 from turning.

The body 132 of female glide assembly 130 in FIGS. 6A and 6B has a curved bottom 133, an upward extending leg insertion member 14, and a receptacle 36. Insertion member 14 and receptacle 36 are as in female glide assembly 30. With assembly 130, the receptacle 36 has a central opening 115 extending through body 132 to the side opposite the receptacle 36, the central opening 115 having a key slot 117 extending inward from the body 132 side opposite the receptacle 36, where an adapter 120 is inserted into the central opening 115 from the body 132 side opposite each receptacle 36 of the female glide assembly 130, the adapter 120 having a head 123 and a shaft 121, the shaft 121 having a key 124 thereon, the key 124 extending outward from the shaft 121 adjacent the adapter head 123, the shaft 120 having a central pilot hole 122 extending inward from the shaft 121 end opposite the head 123 toward the receptacle 36, where the key slot 117 and key 124 engage each other.

With female glide assembly 130, the magnet assemblies have a central countersunk opening 23 therethrough and a screw 20 is received through the central countersunk opening 23 of the magnet assemblies and threaded into the central pilot hole 122 of the shaft 120. As screw 20 is threaded into central pilot hole 122, the engaged key slot 117 and key 124 prevent the adapter 120 from turning.

With particular reference to FIG. 7C, male glide assembly 100 is shown with metal cup 17 extending 0.057 inch beyond the end of receptacle 16. Female glide assembly 130 is shown with metal cup 17 recessed into receptacle 36 by 0.44 inches. The magnet assemblies of both male 100 and female 130 glide assemblies have their respective magnets 18 and 38 recessed into each metal cup 17 by 1/128 inch. Likewise, when looking at FIG. 8C, male 100 and female 130 glide assemblies are shown with the outer ends of their metal cups 17 touching, thereby connecting the glide assemblies 100/130 together. As shown, in this connected relationship, the space 24 between magnets 18 and 38 is 1/64 inch and the space 26 between the outer ends of receptacles 16 and 36 is 0.013 inch. Magnets, such as magnets 18 and 38 can be fragile and subject to breakage. The relationship shown protects the magnets from such breakage, but still places them so close together that they function, along with the touching metal cups, to maintain the glide assemblies 100/130 in a connected relationship until a sufficient external force is applied to pull them apart. Also, the body 12 edges where receptacles 16/36 are located are relatively thin. By not allowing these edges to touch when the glide assemblies 100/130 are in a connected relationship, these relatively thin outer edges of receptacles 16/36 are also protected.

Figure 9:
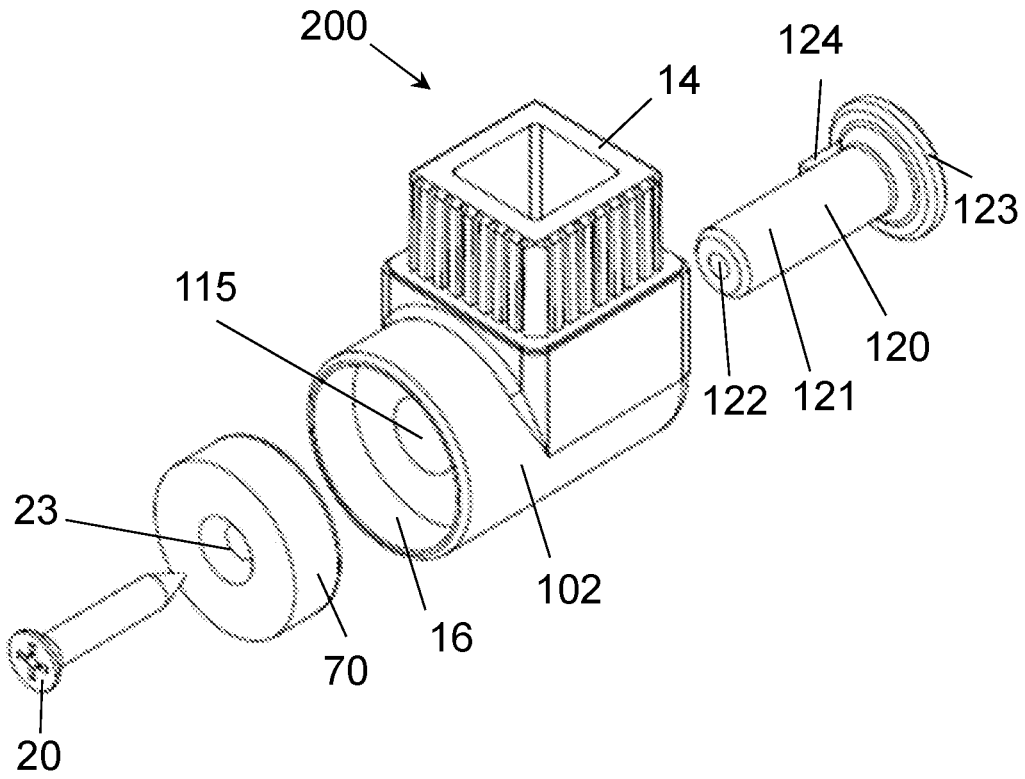
FIG. 9 is a perspective view of an alternative male glide assembly having an adapter received into an opening in the body, the glide assembly replacing its magnetic assembly with a member which is magnetically attracted to the magnet assembly of the other glide assembly.

The previous embodiments of FIGS. 1-8C have utilized magnet assemblies in both the male 10/100 and female 30/130 glide assemblies. The magnets 18/38 utilized are of opposite polarity so they attract to each other. FIG. 9 shows an exploded view of a male glide assembly 200, where a member 70 replaces the metal cup 17, the magnet 18, and the spacer 19 of the male glide assembly 100 of FIG. 5B. The other components of male glide assembly 200 are identical to male glide assembly 100 of FIG. 5B. The member 70 is magnetically attracted to the magnet assembly of a female glide assembly to which it will connect. Member 70 has a member depth. The member 70 is received into the receptacle 16 of the female glide assembly, the receptacle depth being more than the member depth.

Reference systems that may be used herein can refer generally to various directions (e.g., top, bottom, leftward, rightward, forward and rearward), which are merely offered to assist the reader in understanding the various embodiments of the disclosure and are not to be interpreted as limiting.

While examples, one or more representative embodiments, and specific forms of the disclosure, have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used in combination with some or all of the features of other embodiments as would be understood by one of ordinary skill in the art, whether or not explicitly described as such. One or more exemplary embodiments have been shown and described, and all changes and modifications that come within the spirit of the disclosure are desired to be protected.

The invention claimed is:

1. A glide assembly system to connect adjacent furniture legs, comprising:

a. a male glide assembly having a body, the body having a curved bottom portion, the body having an upward extending leg insertion portion and a receptacle extending transverse to the leg insertion portion, the receptacle having a receptacle depth from the receptacle's interior outward; a magnet assembly having a metal cup having an exterior cup depth and an interior cup depth, the metal cup having a bottom and a wall portion, the wall portion having a non-metallic spacer on the wall portion's interior wall portion, the metal cup receiving a magnet therein, the magnet attached to the bottom of the metal cup and abutting the non-metallic spacer, the magnet having a magnet depth, the magnet depth being less than the interior cup depth of the metal cup, the magnet assembly received into the receptacle of the male glide assembly, the receptacle depth being less than the exterior cup depth of the metal cup;

b. a female glide assembly having a body, the body having a curved bottom portion, the body having an upward extending leg insertion portion and a receptacle extending transverse to the leg insertion portion, the receptacle having a receptacle depth from the receptacle's interior outward; a magnet assembly having a metal cup having an exterior cup depth and an interior cup depth, the metal cup having a bottom and a wall portion, the wall portion having a non-metallic spacer on the wall portion's interior wall portion, the metal cup receiving a magnet therein, the magnet attached to the bottom of the metal cup and abutting the non-metallic spacer, the magnet having a magnet depth, the magnet depth being less than the interior cup depth of the metal cup, the magnet assembly received into the receptacle of the female glide assembly, the receptacle depth being more than the exterior cup depth of the metal cup;

c. where the metal cup of the male glide assembly is configured to engage the metal cup of the female glide assembly and prevent the male and female glide assembly magnets from touching, and also prevent the male and female glide assembly receptacles from touching.

2. The glide assembly system of claim 1, where the male and female glide assembly magnets have an opposite polarity to each other.

3. The glide assembly system of claim 1, where the body for each of the male glide assembly and the female glide assembly is a unitary body.

4. The glide assembly system of claim 3, where the magnet assembly of the male glide assembly has a central countersunk opening therethrough, the receptacle of the male glide assembly has a central pilot hole extending into the body, a fastener received through the central countersunk opening of the magnet assembly and received into the pilot hole of the body; and where the magnet assembly of the female glide assembly has a central countersunk opening therethrough, the receptacle of the female glide assembly has a central pilot hole extending into the body thereof, a fastener received through the central countersunk opening of the magnet assembly of the female glide assembly and received into the pilot hole of the body of the female glide assembly.

5. The glide assembly system of claim 1, where the male glide assembly is received into a right front leg of a first chair and the female glide assembly is received into a left front leg of the first chair.

6. The glide assembly system of claim 5, where a second male glide assembly is received into a right front leg of a second chair and a second female glide assembly is received into a left front leg of the second chair, the first and second chairs being connectable by having the metal cup in one of the male glide assemblies engage the metal cup in one of the female glide assemblies.

7. The glide assembly system of claim 1, where the body for each of the male glide assembly and the female glide assembly is a non-unitary body.

8. The glide assembly system of claim 7, wherein the male glide assembly further comprises: where the receptacle of the male glide assembly has a central opening extending through the body to a body side opposite the receptacle, the central opening having a key slot extending inward from the body side opposite the receptacle, where an adapter is inserted into the central opening from the body side opposite the receptacle of the male glide assembly, the adapter having a head and a shaft, the shaft having a key thereon, the key extending outward from the shaft adjacent the adapter head, the shaft having a central pilot hole extending inward from a shaft end opposite the head toward the receptacle, where the key slot and key engage each other; and wherein the female glide assembly further comprises: where the receptacle of the female glide assembly has a central opening extending through the body to a body side opposite the receptacle, the central opening having a key slot extending inward from the body side opposite the receptacle, where an adapter is inserted into the central opening from the body side opposite the receptacle of the female glide assembly, the adapter having a head and a shaft, the shaft having a key thereon, the key extending outward from the shaft adjacent the adapter head, the shaft having a central pilot hole extending inward from a shaft end opposite the head toward the receptacle, where the key slot and key engage each other.

9. The glide assembly system of claim 8, where the magnet assembly of the male glide assembly has a central countersunk opening therethrough, with a fastener received through the central countersunk opening of the magnet assembly and received into the central pilot hole of the shaft of the male glide assembly's adapter; and where the magnet assembly of the female glide assembly has a central countersunk opening therethrough, with a fastener received through the central countersunk opening of the magnet assembly of the female glide assembly and received into the central pilot hole of the shaft of the female glide assembly's adapter.

10. A glide assembly system to connect adjacent furniture legs, comprising:

a. a male glide assembly having a body, the body having a curved bottom portion, the body having an upward extending leg insertion portion configured for insertion into a furniture leg and a receptacle extending transverse to the leg insertion portion, the receptacle having a receptacle depth from the receptacle's interior outward;

b. a female glide assembly having a body, the body having a curved bottom portion, the body having an upward extending leg insertion portion configured for insertion into a furniture leg and a receptacle extending transverse to the leg insertion portion, the receptacle having a receptacle depth from the receptacle's interior outward; and c. at least one of the male glide assembly or the female glide assembly having a magnet assembly having a metal cup having an exterior cup depth and an interior cup depth, the metal cup having a bottom and a wall portion, the wall portion having a non-metallic spacer on the wall portion's interior wall portion, the metal cup receiving a magnet therein, the magnet attached to the bottom of the metal cup and abutting the non-metallic spacer, the magnet having a magnet depth, the magnet assembly received into the glide assembly receptacle.

11. The glide assembly system of claim 10, where the body for each of the male glide assembly and the female glide assembly is a unitary body.

12. The glide assembly system of claim 10, where the body for each of the male glide assembly and the female glide assembly is a non-unitary body.

13. The glide assembly system of claim 12, wherein the male glide assembly further comprises: where the receptacle of the male glide assembly has a central opening extending through the body to a body side opposite the receptacle, the central opening having a key slot extending inward from the body side opposite the receptacle, where an adapter is inserted into the central opening from the body side opposite the receptacle of the male glide assembly, the adapter having a head and a shaft, the shaft having a key thereon, the key extending outward from the shaft adjacent the adapter head, the shaft having a central pilot hole extending inward from a shaft end opposite the head toward the head, where the key slot and key engage each other; and wherein the female glide assembly further comprises: where the receptacle of the female glide assembly has a central opening extending through the body to a body side opposite the receptacle, the central opening having a key slot extending inward from the body side opposite the receptacle, where an adapter is inserted into the central opening from the body side opposite the receptacle of the female glide assembly, the adapter having a head and a shaft, the shaft having a key thereon, the key extending outward from the shaft adjacent the adapter head, the shaft having a central pilot hole extending inward from a shaft end opposite the head toward the head, where the key slot and key engage each other.

* * * * *